US005614149A

United States Patent [19]

Abe et al.

[11] Patent Number: 5,614,149

[45] Date of Patent: Mar. 25, 1997

[54] STAINLESS STEELS FOR COINS AND METHOD OF PRODUCING COINS OF STAINLESS STEEL

[75] Inventors: Hiroshi Abe, Kodaira; Toshihiko Taniuchi, Kawasaki; Masaomi Tsuda, Chuo-ku; Yoshito Fujiwara, Kawasaki, all of Japan

[73] Assignees: Nippon Yakin Kogyo Co., Ltd.; Asahi Seiko Co., Ltd., both of Tokyo, Japan

[21] Appl. No.: 393,006

[22] PCT Filed: Jul. 7, 1994

[86] PCT No.: PCT/JP94/01114

§ 371 Date: Mar. 3, 1995

§ 102(e) Date: Mar. 3, 1995

[87] PCT Pub. No.: WO95/02075

PCT Pub. Date: Jan. 19, 1995

[30] Foreign Application Priority Data

Jul. 8, 1993 [JP] Japan ..... 5-169121

[51] Int. Cl.[6] ..... C22C 38/40; C22C 38/42; C22C 38/44; C21D 8/00

[52] U.S. Cl. ..... 420/43; 420/49; 420/52; 420/56; 420/57; 420/58; 148/610

[58] Field of Search ..... 420/43, 49, 52, 420/56, 57, 58; 148/610, 651

[56] References Cited

U.S. PATENT DOCUMENTS

| | | |
|---|---|---|
| 3,914,506 | 10/1975 | Nishio et al. . |
| 3,926,685 | 12/1975 | Gueussier et al. . |
| 4,090,813 | 5/1978 | Minato et al. . |
| 4,097,311 | 6/1978 | Ishibashi et al. . |
| 4,172,716 | 10/1979 | Abo et al. . |
| 4,222,773 | 9/1980 | Degerbeck . |

(List continued on next page.)

FOREIGN PATENT DOCUMENTS

| | | |
|---|---|---|
| 57-17940 | 2/1980 | Japan . |
| 60-32710 | 12/1981 | Japan . |
| 57-17940 | 4/1982 | Japan . |
| 60-32710 | 7/1985 | Japan . |
| 63-47353 | 2/1988 | Japan . |
| 2141556 | 5/1990 | Japan . |
| 4-66651 | 3/1992 | Japan . |
| 4272158 | 9/1992 | Japan . |

OTHER PUBLICATIONS

English Language Abstract of JP 4–66651.
English Language Abstract of JP 4–272158.
English Language Abstract of JP 57–17940.
English Language Abstract of JP 60–32710.
English Language Abstract of JP 2–141556.
English Language Abstract of JP 63–47353.
Metals Handbook Ninth Edition, vol. 3, Properties and Selection: Stainless Steels, Tool Materials and Special Purpose Metals, American Society for Metals, Metal Park, Ohio, pp. 95–97.
Metals Handbook Tenth Edition, vol. 1, Properties and Selection: Irons, Steels, and High–Performance Alloys, American Society for Metals, Materials Park, Ohio, pp. 841–846.
International Search Report.

*Primary Examiner*—Deborah Yee
*Attorney, Agent, or Firm*—Greenblum & Bernstein P.L.C.

[57] ABSTRACT

Coins, particularly game coins, which are soft and excellent in workability before the coining work and high in hardness and exhibit weak magnetism after the coining work are provided. The stainless steel for coins comprises C: not more than 0.03 wt %, Si: 0.1–1.0 wt %, Mn: 0.1–4 wt %, Ni: 5–15 wt %, Cr: 12–20 wt %, N: not more than 0.03 wt %, O: not more than 50 ppm, and, if necessary, at least one of Cu: 0.5–3.0 wt % and Mo: 0.1–2.0 wt % and austenite stabilization index M value of 20.0–23.0 and ferrite formation ratio F value of not more than 6. A method of producing coins of stainless steel is also provided which comprises subjecting a starting material of such a stainless steel to a cold rolling of 50%, heat-treating at 900°–1100° C. and subjecting to coining work of 15–25%.

12 Claims, 1 Drawing Sheet

U.S. PATENT DOCUMENTS 4,363,952 12/1982 Onishi et al. .
4,378,246 3/1983 Hoshino et al. .
4,812,287 3/1989 Nakayama et al. .
4,837,108 6/1989 Kimura et al. .
4,846,904 7/1989 Arai et al. .
4,858,682 8/1989 Odelstam .
4,933,143 6/1990 Adachi et al. .
4,964,924 10/1990 Yoshitake et al. .
4,999,159 3/1991 Uematsu et al. .
5,000,801 3/1991 Honkura et al. .
5,035,579 7/1991 Yada et al. .
5,035,855 7/1991 Utsunomiya et al. .
5,087,414 2/1992 Maniar .

STAINLESS STEELS FOR COINS AND METHOD OF PRODUCING COINS OF STAINLESS STEEL

TECHNICAL FIELD

This invention relates to stainless steels for coins exhibiting proper magnetism or various weak magnetism through coining work and a method of producing coins of stainless steel. More particularly, it relates to a stainless steel for coins usable as a starting material for coin requiring a precise coining work through cold press, which is soft and excellent in workability before the coining work and is hard and excellent in wear resistance after the coining work, and exhibiting weak magnetism of various levels usable as a material for coins for gaming machines, medals and the like, as well as a method of producing coins by using this stainless steel.

BACKGROUND ART

Recently, the demand for stainless steel as a material for coin, medal or the like has increased. The stainless steel for coins is required to have not only excellent corrosion resistance but also good coining workability and wear resistance. That is, the materials for the coin or medal should be soft for facilitating the work during the coining work and should be hard for providing the wear resistance in use after the coining work.

As conventional stainless steel for coins, there are known a strong magnetic ferritic stainless steel as disclosed in JP-A-63-47353, and a non-magnetic austenitic stainless steel as disclosed in JP-A-4-66651.

However, only the strong magnetic ferritic stainless steel has hitherto been used as a material for game coins. Because, when the non-magnetic austenitic stainless steel is used as a material for coins and medals in a game machine, it is difficult to distinguish from currency (money) made of non-magnetic material such as white copper, brass or the like and hence the elimination of forged currency can not be conducted. For instance, if the coin (medal) for the game is used as a currency (money) in a game machine provided with a simple mechanically selecting mechanism instead of an expensive electronically selecting mechanism, discrimination between the coin and the currency is impossible. For this end, the non-magnetic austenitic stainless steel is not used as a material for the game coin.

Another problem with game coins resides in the fact that each of the many game shops desires to have a game coin inherent to each shop. In this case, the size of the coin is actually changed in each shop in order to distinguish the coins made from the same strong magnetic ferritic stainless steel between the shops. However, discrimination through coin size is impractical due to the regulation of the game machines. Furthermore, in order to distinguish the slight difference between coin sizes, an expensive selecting machine having a high selection precision should be used.

In order to solve the above problems, there have recently been proposed gaming coins being adsorbed or not adsorbed through intensity of magnet (maximum energy product BHmax). This coin is made from a weak magnetic material having a middle adequate magnetism between strong magnetism and non-magnetism and enables the discrimination in accordance with the intensity of magnetism. Such a weak magnetic material for the coin is very useful for distinguishing from the currency of non-magnetic material and the gaming coin of strong magnetic material and conducting the discrimination of the coins among many game shops.

As the conventional weak magnetic material, there is used a specific material obtained by incorporating a slight amount of iron powder into brass. However, it is not easy to uniformly disperse the iron powder into the brass. Even if uniform dispersion is attained, directionality is caused in the iron powder by subsequent rolling work and hence there is a problem causing the scattering of the magnetism. Furthermore, the surface of the material is subjected to Ni plating, so that it is expensive, low in work curing and soft, and hence it is easy to cause scratches after the coining.

Heretofore, it has been well-known that meta-stable stainless steels such as JIS-SUS 304 (austenitic stainless steel) and the like produce strain induced martensite through cold work to have magnetism. However, it is common that sufficient magnetism is not obtained only by the coining at a work degree of 15–25%. Furthermore, the stainless steel precipitating the strain induced martensite is relatively high in hardness and has a drawback that the life of the mold is considerably degraded, so that it is not favorable as a stainless steel for coins.

As mentioned above, conventional stainless steels, such as strong magnetic ferritic stainless steel, non-magnetic austenitic stainless steel and martensite precipitated austenitic stainless steel have drawbacks as the stainless steel for coins.

An object of the invention is to propose relatively cheap and weak magnetic stainless steels for coins which are soft and easy to work at raw material stage, are hard after the coining work and have excellent wear resistance and durability and appropriate magnetism for discrimination between coin and currency.

Another object of the invention is to propose a method of advantageously producing coins from the above stainless steels for coins.

DISCLOSURE OF INVENTION

The invention is a weak magnetic stainless steel for coins which is soft and easy as a raw material in coining work, and is hard after the coining work to providing a coin which has a excellent wear resistance and at the same time exhibits appropriate weak magnetism.

The stainless steel according to the invention develops a weak magnetism or weak magnetic property by coining work. The term "weak magnetism" used herein means that a suction force to permanent magnet is a value of constant range. That is, it means that when the distance between the permanent magnet having a magnetic force of 640 kG and the coin is 0.5 mm, the suction force attracting the coin is within a range of 2–13 g. When the suction force is less than 2 g, the coin does not operate to the magnet in the selecting machine, while when the suction force exceeds 13 g, the magnetic force is too large and bad operation of the selecting machine is caused.

The weak magnetism ferritic stainless steel having the above features has the following constructions: (1) The invention is directed to a stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm and the balance being Fe and inevitable impurities and being adjusted to a composition satisfying that an index of austenite stabilization (M value) represented by the following equation (1):

$$M=Ni+12.6(C+N)+0.35Si+0.7Mn+0.65Cr \quad (1)$$

is within a range of 20.0–23.0.

(2) The invention is also directed to a stainless steel for coins further containing Cu: 0.5–3.0 wt % in addition to the main components of the above item (1) and being adjusted to a composition satisfying that an index of austenite stabilization (M value) represented by the following equation (2):

$$M=Ni+12.6(C+N)+0.35Si+0.7Mn+0.65Cr+1.2Cu \quad (2)$$

is within a range of 20.0–23.0.

(3) The invention is also directed to a stainless steel for coins further containing Cu: 0.5–3.0 wt % and Mo: 0.1–2.0 wt % in addition to the main components of the above item (1) and being adjusted to a composition satisfying that an index of austenite stabilization (M value) represented by the following equation (3):

$$M=Ni+12.6(C+N)+0.35Si+0.7Mn+0.65Cr+1.2Cu+0.98Mo \quad (3)$$

is within a range of 20.0–23.0.

(4) The invention is also directed to a stainless steel for coins being adjusted to a composition in each stainless steel of the above items (1)–(3) satisfying that an index of ferrite formation (F value) represented by the following equation (4), (5) or (6):

$$F=2.9(Cr+1.4Si)-(3.5Ni+1.3Mn+195C+10N)-10.9 \quad (4)$$

$$F=2.9(Cr+1.4Si)-(3.5Ni+1.3Mn+195C+10N+2.4Cu)-10.9 \quad (5)$$

$$F=2.9(Cr+Mo+1.4Si)-(3.5Ni+1.3Mn+195C+10N+2.4Cu)-10.9 \quad (6)$$

is not more than 6.

(5) The invention is also directed to a method of producing coins of weak magnetism stainless steel which comprises subjecting each stainless steel in the above items (1)–(4) to cold rolling at a working ratio of not less than 50% heat-treating at 900°–1100° C., rendering the resulting cold rolled steel sheet into a given shape through blanking, and then subjecting to coining work at a rolling reduction of 15–25%.

BEST MODE FOR CARRYING OUT THE INVENTION

Preferable conditions for carrying out the invention will be described below.

The stainless steels according to the invention explained in the above disclosure of the steel are excellent in workability before the coining work because the Vickers hardness is low (Hv<140), while they are excellent in the wear resistance and exhibit weak magnetism of various levels after the coining work because the hardness shows an adequate value (Hv>270).

The reasons for numerical limitation of each component in the invention, as well as the function of the component will be described below.

C, N: not more than 0.03 wt %

C, N generally produce strain induced martensite (α') developing magnetism through cold work in case of austenite stainless steel. In this case, when C and N are existent in a great amount, the steel becomes hard due to the formation of α' to promote work hardening and hence degrade the workability and the corrosion resistance. Therefore, the amount of each of C, N is limited to not more than 0.03 wt %.

Si: 0.1–1.0 wt %

Si is added in an amount of not less than 0.1 wt % as a deoxidizing agent, and it is desirable to be low for making the steel soft to improve its hot workability, and is not more than 1.0 wt %. Preferably, it is within a range of 0.5–0.8 wt %.

Mn: 0.1–4.0 wt %

Mn is added as a deoxidizing agent like Si. As the amount of Mn becomes large, the steel is made softer. When it is less than 0.1 wt % the deoxidizing effect is weak, while when it exceeds 4 wt %, the hot workability and corrosion resistance are degraded. Preferably, it is within a range of 0.5–2.0 wt %.

Ni: 5–15 wt %

Ni is an inevitable element in the austenite stainless steel, and is necessary to be not less than 5 wt % in order to obtain an adequate amount of α' phase. When it exceeds 15 wt %, the austenite structure phase is stabilized to form non-magnetism, so that it is within a range of 5–15 wt %.

Preferably, it is within a range of 7–10 wt %.

Cr: 12–20 wt %

Cr is an element most effective for ensuring the corrosion resistance of the stainless steel and is actually required to be included in an amount of not less than 12 wt %. However, when it exceeds 20 wt %, ferrite is produced to obstruct the hot workability. Therefore, Cr is within a range of 12–20 wt %, preferably 15–18 wt %.

Cu: 0.5–3 wt %

Cu is an element forming austenite and is an element very effective for lowering hardness and work hardening. This effect is developed by addition exceeding 0.5 wt %. When it exceeds 3 wt %, hot workability is degraded and edge cracking is caused during hot rolling to lower productivity, so that it is limited to a range of 0.5–3 wt %. Preferably, it is within a range of 1.5–2.0 wt %.

Mo: 0.1–2 wt %

Mo is a component contributing to oxidation resistance and corrosion resistance and the amount thereof is limited to 0.1–2 wt %. When the amount is less than 0.1 wt %, the above effect is not developed, while when it exceeds 2 wt %, the above effect is saturated and the production cost is increased. Preferably, it is within a range of 0.1–0.5 wt %.

O: not more than 50 ppm

O is an element important for the determination of steel cleanness. When the amount exceeds 50 ppm, the cleanness of steel is degraded due to non-metallic inclusion, which results in the degradation of blanking work and surface property after the coining work. Therefore, it is not more than 50 ppm.

Further, in order to improve properties, such as strength required in accordance with applications of coins, hot workability, cold workability, coining workability, corrosion resistance and the like in the invention, elements such as Ti, Nb, Zr, Hf, Be, Co, Al, V, B and the like may be included, if necessary.

Index of austenite stabilization (M value):

In the invention, the M value gives a standard for adjusting a composition so as to develop magnetism even at a coining work having a small working ratio. That is, the amount of strain induced martensite α' required for the development of magnetism is closely related to a degree of austenite stabilization in austenite, so that the degree of magnetism development can be controlled by clarifying the index of austenite stabilization. As an index, there are used the following equations (1)–(3). It is recognized that there is a good relation between the magnetism developed by coining work or α' amount (suction force) and the M value.

When the M value is less than 20.0, a great amount of martensite is precipitated to form a strong magnetism stainless steel having a suction force of more than 13 g at a coin state. While, when the M value exceeds 23.0, the precipitation of martensite is obstructed to form a non-magnetism stainless steel having a suction force of less than 2.0 g at a coin state.

Therefore, in order to ensure weak magnetism required in the invention, the M value is within a range of 20.0–23.0.

$$M=Ni+12.6(C+N)+0.35Si+0.7Mn+0.65Cr \quad (1)$$

$$M=Ni+12.6(C+N)+0.35Si+0.7Mn+0.65Cr+1.2Cu \quad (2)$$

$$M=Ni+12.6(C+N)+0.35Si+0.7Mn+0.65Cr+1.2Cu+0.98Mo \quad (3)$$

Ratio of ferrite formation (F value):

The F value is an indication showing a ratio of ferrite formation in steel. When the F value exceeds 6, the hot workability is obstructed. From this fact, the F value determined from the following equations (4)–(6) as an indication is limited to not more than 6. Preferably, it is within a range of 3–5.

$$F=2.9(Cr+1.4Si)-(3.5Ni+1.3Mn+195C+10N)-10.9 \quad (4)$$

$$F=2.9(Cr+1.4Si)-(3.5Ni+1.3Mn+195C+10N+2.4Cu)-10.9 \quad (5)$$

$$F=2.9(Cr+Mo+1.4Si)-(3.5Ni+1.3Mn+195C+10N+2.4Cu)-10.9 \quad (6)$$

As mentioned above, according to the invention, in order to develop an adequate magnetism after the coining work, it is necessary to adjust the composition in order that the M value according to the equation (1), (2) or (3) is within a range of 20.0–23.0 in addition to the control of the composition. Further, in order to obtain the stable productivity (hot workability), it is further required to control the composition satisfying that the F value according to the equation (4), (5) or (6) is not more than 6.0.

The production of coins from the stainless steel according to the invention will be described below.

At first, the stainless steel having the above composition is melted, cast, hot rolled and then cold rolled. The working ratio and heat-treating temperature in the cold rolling have an important influence on material properties after the coining work.

a. When the working ratio in the cold rolling is less than 50%, the recrystallization structure is not sufficiently obtained at subsequent heat treatment and hence mixed grains are produced, which are lacking in the uniformity of metal flow in the coining and degrade the pattern definition after the coining work. Therefore, it is necessary that the working ratio in the cold rolling is not less than 50%.

b. On the other hand, the heat treatment is carried out within a temperature range of 900°–1100° C. When the temperature is lower than 900° C., the hardness Hv is not less than 150 and the workability is poor. While, when it exceeds 1100° C., the structure becomes coarse (crystal grain number of not more than 4) and the pattern definition after the coining work is poor. Therefore, the heat-treating temperature for providing uniform recrystallization structure and clear pattern through coining work is within a range of 900°–1100° C.

c. In the invention, the cold rolled steel sheet is then rendered into a given shape through blanking and thereafter subjected to a coining work at a rolling reduction of 15–25%.

In this case, coins having various weak magnetisms are obtained in accordance with the amount of martensite precipitated through the coining work. That is, the intensity of magnetization (I) can be changed by the rolling reduction and the control of the above composition, whereby coins having magnetism inherent to each shop can be produced.

The stainless steel coins obtained through the above production method can hold Hv hardness of 110–150 and exhibit weak magnetism.

In the invention, the range of weak magnetism applicable for the coins is suitably within a range of 4–25 emu/g as Mn. In this range, stainless steels for coins having different magnetisms for every shop can be provided and discrimination becomes easy.

EXAMPLE

In Table 1 are shown chemical compositions of Invention Examples and Comparative Examples together with M value and F value of each steel calculated according to the above equations (1)–(6). Each of these steels No. 1–No. 15 was melted in an induction furnace in air to form a steel ingot of 10 kg, which was subjected to hot forging and hot rolling at a heating temperature of 1200°–1300° C. to obtain a hot rolled steel sheet of 3.8 mm in thickness. The hot rolled steel sheet was annealed by soaking at 1100° C. for 2 minutes, pickled and cold rolled to a thickness of 1.5 mm (cold rolling ratio of 60%). The cold rolled steel sheet was annealed by soaking at 1050° C. for 1 minute, pickled and softened to produce a cold rolled steel sheet, and then the hardness thereof was measured. Thereafter, the steel sheet was blanked into a coin shape of 24.4 mmϕ in diameter, which was subjected to coining work at a rolling reduction of 21% to obtain a specimen.

Figure 1:
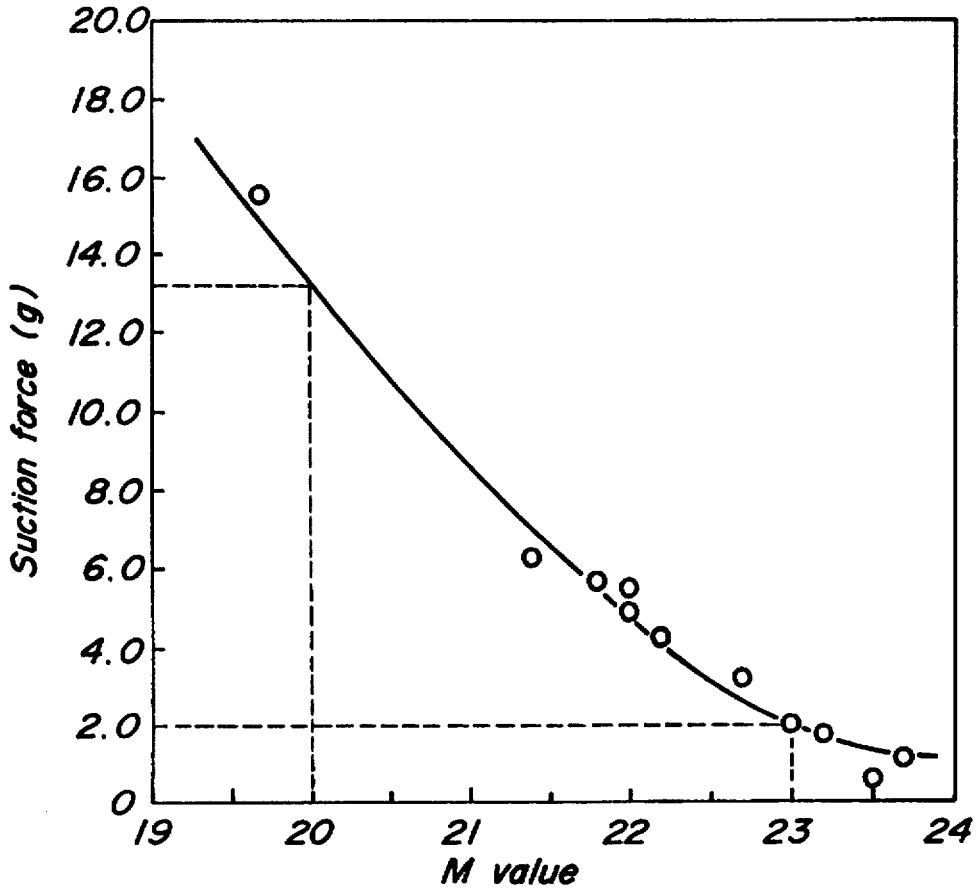
FIG. 1 is a graph showing a relation between index of austenite stabilization M value and suction force in coins subjected to coining work of 21%.

In FIG. 1 is shown a relation between M value and suction force in each specimen. The suction force is understood to lower with the increase of the M value. As seen from the results of this figure, it is necessary that the M value is within a range of 20.0–23.0 in order that the suction force as an indication of weak magnetism is within a range of 2–13 g.

Figure 2:
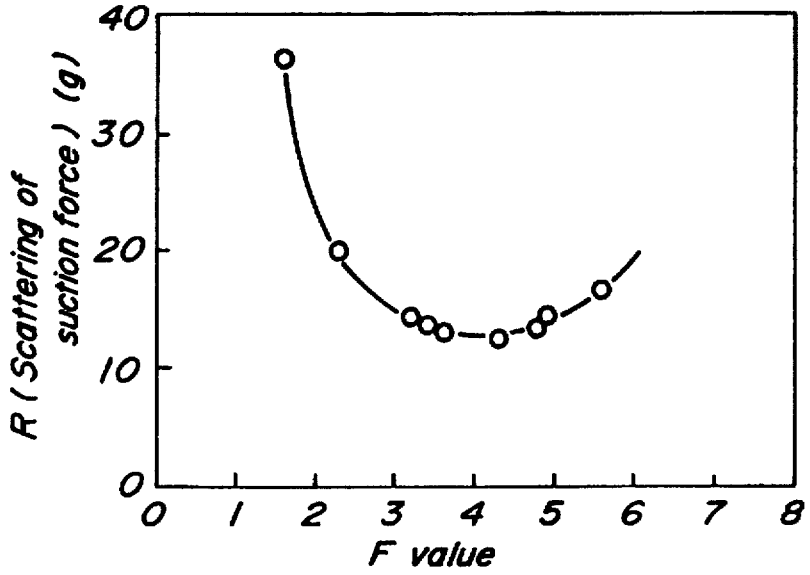
FIG. 2 is a graph showing a relation between scattering of suction force and ratio of ferrite formation F value in coins subjected to coining work of 21%.

In FIG. 2 is shown a relation between F value and suction force in the specimen showing the suction force of 3–7 g. As seen from the results of this figure, the scattering of the suction force has a minimum range in accordance with the F value. That is, in order to obtain the stability of suction force, it is preferable that the F value is within a range of 3.0–5.0.

Furthermore, it is understood from the results of Table 1 that the comparative steel No. 11 is poor in the hot workability because the hardness Hv is as high as 185 and the F value is 9.7 higher than the restricted range and the reduction of area at hot rolling of 1000° C. is as low as 45%.

And also, the M value is lower than the restricted range, so that strong magnetism is exhibited. Moreover, the comparative steels Nos. 12, 13, 14 and 15 are higher in M value than the restricted range and do not provide sufficient suction force.

To the contrary, the invention steels Nos. 1–10 have an M value of adequate range and are existent in a weak magnetism region. Particularly Nos. 7–10 satisfy the M value and F value, so that they are very soft and easy in the coining work and can provide coins having small scattering (σ) of magnetism and excellent quality.

8, 9 and 10, respectively. As shown in Table 2, the comparative examples (D, E, F) are:

Method D: an example having an adequate working ratio and a low temperature . . . hardness is high and unrecrystallization structure still remains.

Method E: an example having an adequate working ratio and a high temperature . . . crystal grains become coarse to have a crystal grain size of 4.0, and coining workability is poor.

Method F: an example having an inadequate working ratio and an adequate heating temperature . . . mixed grain structure, and coining workability is poor.

TABLE 1

| Steel No. | Composition (wt %) C | Si | Mn | Ni | Cr | Cu | Mo | N | O (ppm) | M value | F value | Suction force average (g) | Suction force R average (g) | Scattering (%) | Hardness (Hv) | Reduction of areal (%) 1000° C. |
|---|---|---|---|---|---|---|---|---|---|---|---|---|---|---|---|---|
| Invention steels | | | | | | | | | | | | | | | | |
| 1 | 0.020 | 0.69 | 1.97 | 9.51 | 17.03 | — | — | 0.019 | 37 | 22.7 | 1.6 | 3.0 | 1.1 | 36.6 | 142 | 85 |
| 2 | 0.020 | 0.62 | 0.88 | 9.04 | 17.07 | — | — | 0.017 | 38 | 21.4 | 4.9 | 6.2 | 0.9 | 14.5 | 142 | 79 |
| 3 | 0.020 | 0.71 | 1.28 | 9.07 | 17.04 | — | — | 0.019 | 42 | 21.8 | 4.3 | 5.6 | 0.7 | 12.5 | 144 | 80 |
| 4 | 0.020 | 0.68 | 1.65 | 9.05 | 17.05 | — | — | 0.019 | 48 | 22.0 | 3.6 | 5.4 | 0.7 | 13.0 | 144 | 80 |
| 5 | 0.020 | 0.69 | 1.96 | 8.89 | 17.03 | — | 0.16 | 0.017 | 40 | 22.2 | 3.2 | 4.2 | 0.6 | 14.3 | 143 | 85 |
| 6 | 0.020 | 0.73 | 1.48 | 7.38 | 15.96 | 2.01 | — | 0.019 | 38 | 22.0 | 2.3 | 5.0 | 1.0 | 20.0 | 115 | 90 |
| 7 | 0.021 | 0.74 | 1.48 | 8.39 | 15.92 | 2.0 | — | 0.020 | 40 | 23.0 | −2.1 | 2.0 | 0.4 | 20.0 | 114 | 87 |
| 8 | 0.016 | 0.68 | 1.53 | 7.11 | 16.52 | 1.52 | 0.18 | 0.021 | 28 | 21.8 | 5.6 | 5.4 | 0.9 | 16.7 | 119 | 81 |
| 9 | 0.020 | 0.72 | 1.52 | 7.56 | 16.23 | 1.57 | 0.21 | 0.019 | 47 | 22.0 | 4.8 | 5.2 | 0.7 | 13.5 | 120 | 80 |
| 10 | 0.021 | 0.70 | 1.51 | 7.52 | 16.48 | 1.58 | — | 0.018 | 35 | 22.0 | 3.4 | 5.1 | 0.7 | 13.7 | 119 | 82 |
| Comparative steels | | | | | | | | | | | | | | | | |
| 11 | 0.020 | 0.64 | 0.55 | 7.53 | 17.06 | — | — | 0.018 | 33 | 19.7 | 9.7 | 5.4 | 4.0 | 17.5 | 185 | 45 |
| 12 | 0.021 | 0.70 | 1.97 | 9.99 | 17.01 | — | — | 0.019 | 35 | 23.2 | −0.8 | 1.7 | 0.8 | 47.0 | 147 | 85 |
| 13 | 0.021 | 0.70 | 1.97 | 10.50 | 17.01 | — | — | 0.018 | 28 | 23.7 | −2.6 | 1.1 | 0.4 | 36.4 | 143 | 85 |
| 14 | 0.020 | 1.01 | 1.94 | 10.07 | 18.04 | — | — | 0.021 | 49 | 24.0 | 4.8 | 0.9 | 0.4 | 44.4 | 146 | 80 |
| 15 | 0.019 | 0.73 | 1.47 | 9.38 | 15.92 | 2.01 | — | 0.019 | 42 | 23.5 | −5.5 | 0.5 | 0.2 | 17.7 | 124 | 88 |

Table 2 shows a comparison of the effect of the production method according to the invention (A, B, C) with methods D, E, F of the comparative examples using specimens Nos.

To the contrary, the methods A, B and C according to the invention are soft in the steel and fine grain structure and good in the coining work.

TABLE 2

| | Method | Steel No | Cold rolling ratio (%) | Temperature (°C.) | Working ratio at coining work (%) | Suction force (g) average | Suction force (g) R average | Hardness (Hv) | Crystal grain size (No) | Coining property |
|---|---|---|---|---|---|---|---|---|---|---|
| Invention method | A | 8 | 50 | 950 | 21.4 | 5.4 | 0.9 | 135 | 8.5 | ○ |
| | B | 9 | 60 | 1000 | 21.4 | 5.2 | 0.7 | 127 | 7.7 | ○ |
| | C | 10 | 60 | 1050 | 21.4 | 5.2 | 0.7 | 120 | 7.0 | ○ |
| Comparative method | D | 8 | 50 | 800 | 21.4 | 8.1 | 1.8 | 190 | unrecrystallization | x |
| | E | 9 | 60 | 1150 | 21.4 | 5.3 | 0.7 | 111 | 4.0 | x |
| | F | 10 | 35 | 1000 | 21.4 | 6.5 | 1.3 | 130 | Mixed grain structure | x |

INDUSTRIAL APPLICABILITY

As mentioned above, in the stainless steel for coins according to the invention, there are obtained properties as a material for game coins, which have never been attained with conventional stainless steel. More specifically, the steel is soft before coining work and hard after the coining work and exhibits weak magnetism. Therefore, the stainless steels for coins according to the invention have magnetic properties different from those of non-magnetism and strong magnetism stainless steels, so that the selection of coins can precisely be conducted in not only electronically selecting machines with a high accuracy but also cheap, mechanical and magnetic selecting machines and hence it is possible to obtain variations for the selection of game coins. Furthermore, coins having different magnetisms can easily be obtained, so that many kinds of coins having an easy selection can be provided for different shapes.

We claim:

1. A stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm and the balance being Fe and inevitable impurities and being adjusted to a composition satisfying that an index of austenite stabilization (M value) represented by the following equation (1):

$$M=Ni+12.6(C+N)+0.35Si+0.7Mn+0.65Cr \quad (1)$$

is within a range of 20.0–23.0 and weak magnetism is exhibited through coining work.

2. A stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt % and the balance being Fe and inevitable impurities and being adjusted to a composition satisfying that an index of austenite stabilization (M value) represented by the following equation (2):

$$M=Ni+12.6(C+N)+0.35Si+0.7Mn+0.65Cr+1.2Cu \quad (2)$$

is within a range of 20.0–23.0 and weak magnetism is exhibited through coining work.

3. A stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt %, Mo: 0.1–2.0 wt % and the balance being Fe and inevitable impurities and being adjusted to a composition satisfying that an index of austenite stabilization (M value) represented by the following equation (3):

$$M=Ni+12.6(C+N)+0.35Si+0.7Mn+0.65Cr+1.2Cu+0.98Mo \quad (3)$$

is within a range of 20.0–23.0 and weak magnetism is exhibited through coining work.

4. A stainless steel for coins comprising C: not more than 0.03 wt % Si: 0.1—not more than 1.0 wt %, Mn: 0.1—not more than 4 wt % Ni: 5–15 wt %, Cr: 12–20 wt %. N: not more than 0.03 wt %, O: not more than 50 ppm and the balance being Fe and inevitable impurities and being adjusted to a composition satisfying that an index of austenite stabilization (M value) represented by the following equation (1):

$$M=Ni+12.6(C+N)+0.35Si+0.7Mn+0.65Cr \quad (1)$$

is within a range of 20.0–23.0 and weak magnetism is exhibited through coining work, and further satisfying that an index of ferrite formation (F value) represented by the following equation (4):

$$F=2.9(Cr+1.4Si)-(3.5Ni+1.3Mn+195C+10N)-10.9 \quad (4)$$

not more than 6.

5. A stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt % and the balance being Fe and inevitable impurities and being adjusted to a composition satisfying that an index of austenite stabilization (M value) represented by the following equation (2):

$$M=Ni+12.6(C+N)+0.35Si+0.7Mn+0.65Cr+1.2Cu \quad (2)$$

is within a range of 20.0–23.0 and weak magnetism is exhibited through coining work, and further satisfying that an index of ferrite formation (F value) represented by the following equation (5):

$$F=2.9(Cr+1.4Si)-(3.5Ni+1.3Mn+195C+10N+2.4Cu)-10.9 \quad (5)$$

is not more than 6.

6. A stainless steel for coins comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt %, Mo: 0.1–2.0 wt % and the balance being Fe and inevitable impurities and being adjusted to a composition satisfying that an index of austenite stabilization (M value) represented by the following equation (3):

$$M=Ni+12.6(C+N)+0.35Si+0.7Mn+0.65Cr+1.2Cu+0.98Mo \quad (3)$$

is within a range of 20.0–23.0 and weak magnetism is exhibited through coining work, and further satisfying that an index of ferrite formation (F value) represented by the following equation (6):

$$F=2.9(Cr+Mo+1.4Si)-(3.5Ni+1.3Mn+195C+10N+2.4Cu)-10.9 \quad (6)$$

is not more than 6.

7. A method of producing coins of stainless steel which comprises subjecting stainless steel of C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm and the balance being Fe and inevitable impurities, which is adjusted to a composition satisfying that an index of austenite stabilization (M value) represented by the following equation (1):

$$M=Ni+12.6(C+N)+0.35Si+0.7Mn+0.65Cr \quad (1)$$

is within a range of 20.0–23.0 and weak magnetism is exhibited through coining work, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

8. A method of producing coins of stainless steel which comprises subjecting stainless steel of C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, CU; 0.5–3.0 wt % and the balance being Fe and inevitable impurities, which is adjusted to a composition satisfying that an index of austenite stabilization (M value) represented by the following equation (2):

$$M=Ni+12.6(C+N)+0.35Si+0.7Mn+0.65Cr+1.2Cu \quad (2)$$

is within a range of 20.0–23.0 and weak magnetism is exhibited through coining work, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

9. A method of producing coins of stainless steel which comprises subjecting stainless steel of C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt %, Mo: 0.1–2.0 wt % and the balance being Fe and inevitable impurities, which is adjusted to a composition satisfying that an index of austenite stabilization (M value) represented by the following equation (3):

$$M=Ni+12.6(C+N)+0.35Si+0.7Mn+0.65Cr+1.2Cu0.98Mo \quad (3)$$

is within a range of 20.0–23.0 and weak magnetism is exhibited through coining work, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

10. A method of producing coins of stainless steel which comprises subjecting stainless steel of C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm and the balance being Fe and inevitable impurities, which is adjusted to a composition satisfying that an index of austenite stabilization (M value) represented by the following equation (1):

$$M=Ni+12.6(C+N)+0.35Si+0.7Mn+0.65Cr \quad (1)$$

is within a range of 20.0–23.0 and weak magnetism is exhibited through coining work, and further satisfying that an index of ferrite formation (F value) represented by the following equation (4):

$$F=2.9(Cr+1.4Si)-(3.5Ni+1.3Mn+195C+10N)-10.9 \quad (4)$$

not more than 6, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

11. A method of producing coins of stainless steel comprising C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt % and the balance being Fe and inevitable impurities, which is adjusted to a composition satisfying that an index of austenite stabilization (M value) represented by the following equation (2):

$$M=Ni+12.6(C+N)+0.35Si+0.7Mn+0.65Cr+1.2Cu \quad (2)$$

is within a range of 20.0–23.0 and weak magnetism is exhibited through coining work, and further satisfying that an index of ferrite formation (F value) represented by the following equation 5):

$$F=2.9(Cr+1.4Si)-(3.5Ni+1.3Mn+195C+10N+2.4Cu)-10.9 \quad (5)$$

is not more than 6, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

12. A method of producing coins of stainless steel which comprises subjecting stainless steel of C: not more than 0.03 wt %, Si: 0.1—not more than 1.0 wt %, Mn: 0.1—not more than 4 wt %, Ni: 5–15 wt %, Cr: 12–20 wt %, N: not more than 0.03 wt %, O: not more than 50 ppm, Cu: 0.5–3.0 wt %, Mo: 0.1–2.0 wt % and the balance being Fe and inevitable impurities, which is adjusted to a composition satisfying that an index of austenite stabilization (M value) represented by the following equation (3):

$$M=Ni+12.6(C+N)+0.35Si+0.7Mn+0.65Cr+1.2Cu+0.98Mo \quad (3)$$

is within a range of 20.0–23.0 and weak magnetism is exhibited through coining work, and further satisfying that an index of ferrite formation (F value) represented by the following equation (6):

$$F=2.9(Cr+Mo+1.4Si)-(3.5Ni+1.3Mn+195C+10N+2.4Cu)-10.9 \quad (6)$$

is not more than 6, to a cold rolling at a working ratio of not less than 50%, heat-treating at 900°–1100° C., rendering the resulting cold rolled steel sheet into a given shape through blanking, and then subjecting to coining work at a rolling reduction of 15–25%.

* * * * *

UNITED STATES PATENT AND TRADEMARK OFFICE

CERTIFICATE OF CORRECTION

PATENT NO. : 5,614,149

DATED : March 25, 1997

INVENTOR(S) : H. ABE et al.

It is certified that error appears in the above-indentified patent and that said Letters Patent is hereby corrected as shown below:

At column 10, line 11 (claim 4, line 15), before "not" insert ---is---.

At column 12, line 3 (claim 10, line 15), before "not" insert ---is---.

At column 12, line 22 (claim 11, line 13), change "5):" to ---(5):---.

Signed and Sealed this

Ninth Day of September, 1997

*Attest:*

Bruce Lehman

BRUCE LEHMAN

*Attesting Officer*

*Commissioner of Patents and Trademarks*